United States Patent [19]

Walters

[11] 4,031,888

[45] June 28, 1977

[54] BREATHING MOUTHPIECE FOR UNDERWATER USE

[76] Inventor: William D. Walters, 2940 Andros St., Costa Mesa, Calif. 92626

[22] Filed: Jan. 5, 1976

[21] Appl. No.: 646,878

[52] U.S. Cl. ..... 128/145 A; 128/136; 128/147

[51] Int. Cl.[2] ..... A62B 7/00

[58] Field of Search ..... 128/147, 145 R, 145 A, 128/142.4, 145.5, 208, 136

[56] References Cited

UNITED STATES PATENTS

| | | | |
|---|---|---|---|
| 2,857,911 | 10/1958 | Bennett | 128/147 |
| 3,079,916 | 3/1963 | Marsden | 128/147 |
| 3,123,680 | 3/1964 | Minton, Jr. et al. | 128/147 |
| 3,347,230 | 10/1967 | Cupp | 128/147 |
| 3,768,465 | 10/1973 | Helmer | 128/136 |

*Primary Examiner*—Robert W. Michell
*Assistant Examiner*—Henry J. Recla
*Attorney, Agent, or Firm*—Fulwider, Patton, Rieber, Lee & Utecht

[57] ABSTRACT

A mouthpiece reducing fatigue and permitting the wearer to communicate by speech under water, including a cupped housing shaped to fit over the wearer's mouth, the housing having a central breathing port, and a pair of bit elements affixed interiorly to the housing and extending into the wearer's mouth to be gripped by the molar teeth, thereby allowing substantial movement of the lips and limited movement of the front teeth in normal speech.

5 Claims, 6 Drawing Figures

BREATHING MOUTHPIECE FOR UNDERWATER USE

BACKGROUND OF THE INVENTION

This invention relates generally to skin diving equipment, and, more particularly, to a breathing mouthpiece designed to reduce diver fatigue and facilitate underwater speech communication either with or without a microphone.

The rapid increase in the popularity of skin diving as a recreational activity in recent years has focused attention on the need for a mouthpiece which can be worn with less fatigue to the diver, and also the need for some means of underwater speech communication between divers, as well as between divers and those on the surface. The mouthpiece currently used by most divers includes an inwardly projecting bit element having an enlarged portion which fits behind the incisors or front teeth, and is held in position with the front teeth clamping down on the bit element outwardly of the enlarged portion. This is very tiring to the diver over a long period of time. The bit element usually includes a sealing flap which fits between the lips and the teeth. It can readily be appreciated that this type of mouthpiece almost totally precludes any movement of the teeth or lips, and thereby prevents speech communication by the diver.

A mouthpiece invented by J. A. Minton, Jr., et al., and disclosed in U.S. Pat. No 3,123,680, represents a significant improvement over the aforedescribed conventional mouthpiece, in that it provides two bit members symmetrically disposed about the center of the mouthpiece, so that the central portions of the lips of the wearer are movable to some degree. However, the two bit members of the Minton mouthpiece must still be gripped by the teeth located toward the front of the mouth, probably the canine or semimolar teeth, thus still precluding any movement of the teeth or any substantial movement of the lips in the formation of speech sounds.

It will be apparent from the foregoing that there still exists a need for a mouthpiece for underwater use whih can be worn with much less fatigue to the diver and which allows convenient speech communication by the diver, either with or without a microphone. The present invention fulfills this need.

SUMMARY OF THE INVENTION

The present invention resides in a breathing mouthpiece for underwater use which allows substantial movement of the diver's lips, and limited movement of the diver's front teeth, thereby facilitating underwater speech communication. Similar to the mouthpiece of Minton, et al., described above, the mouthpiece of the present invention includes a cupped flexible housing having an edge contoured to fit snugly around the mouth of the user, and having a central port adapted for connection to breathing apparatus. In accordance with the invention, the mouthpiece also includes a pair of flexible and resilient bit members affixed interiorly to the housing on opposing sides of the central port and extending from the housing inwardly with respect to the mouth, the bit members being sized and spaced to allow them to be gripped at their ends by the diver's molar teeth. This gripping by the molars is relatively effortless compared to the constant gripping by the front teeth, which is required in currently popular mouthpieces for regulators and snorkel tubes. Movement of the diver's lips is unimpeded by the mouthpiece, and, since the portion of the resilient bit elements gripped by the molar teeth is of substantial thickness, the bit elements also allow limited movement of the front teeth in the articulation of speech sounds.

Speech sounds from the diver are carried through the central port and may be picked up by a microphone incorporated into the breathing apparatus, for subsequent transmission to the surface, or for amplification and transmission to an underwater loudspeaker. Even without the use of a microphone, it has been found that the speech sounds articulated by divers using the mouthpiece of this invention will carry for a limited distance under water. Consequently divers wearing the mouthpiece may communicate directly by speech, without the use of microphones or other electrical equipment. It will be appreciated that this facility provides a vast improvement in diving safety practices, as well as increasing the pleasure to be derived from diving activities. When the mouthpiece is used as a part of a snorkel tube, the ease of gripping by the molar teeth is the primary benefit to the diver, but the articulation of speech sounds is also valuable in this application as well.

Other aspects and advantages of the invention will become apparent from the following more detailed description taken in conjunction with the accompanying drawings.

DETAILED DESCRIPTION

Figure 1:
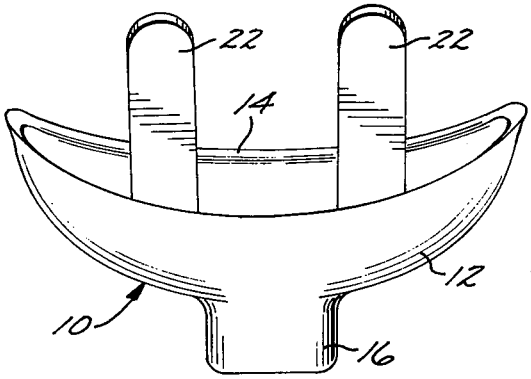
FIG. 1 is a perspective view of the mouthpiece of the present invention.
Figure 2:
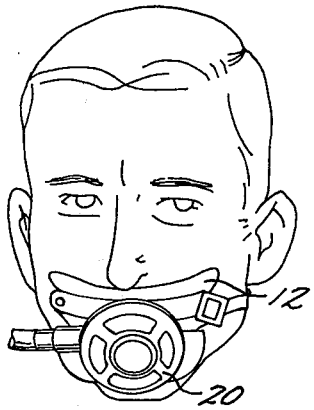
FIG. 2 is a perspective view of the head of a diver using the mouthpiece connected with breathing apparatus.

As shown in the drawings for purposes of illustration, the present invention is concerned with a breathing mouthpiece, indicated by the reference numeral 10, for underwater use in scuba diving. The mouthpiece 10 includes a cupped flexible housing 12 which, as can be seen in FIG. 1, is substantially crescent-shaped when viewed from above or below as worn on the mouth. The housing 12 has an edge 14 contoured to fit snugly around the mouth, with the edge being shaped substantially from the lips to permit their free movement when the mouthpiece is fitted. Integrally formed with the housing 12 is a central tube 16 defining a central breathing port 18 through which the diver inhales and exhales. As shown in FIG. 2, the tube 16 is adapted for connection to an air supply regulator unit 20 of conventional design, which, in turn, is adapted for connection to conventional breathing apparatus (not shown).

Figure 3:
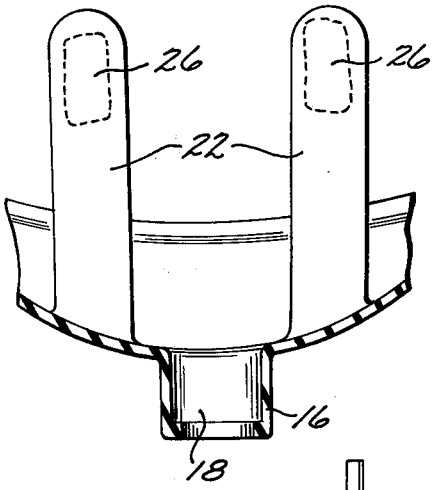
FIG. 3 is an enlarged fragmentary view of the mouthpiece, shown partly in section.

In accordance with the invention, the mouthpiece 10 includes a pair of bit elements 22 integral with or firmly attached to the interior of the housing 12, on opposite sides of the port 18, and extending in parallel spaced relation inwardly with respect to the diver's mouth when the mouthpiece is worn. The bit elements are of flexible resilient material and are spaced and sized to be gripped principally by the diver's molar teeth, i.e., the three rearmost upper and lower teeth on each side of the jaw. The bit elements 22 in the presently preferred embodiment of the invention have substantial width, to provide a relatively large gripping area, as indicated at 26 in FIG. 3.

Figure 4:
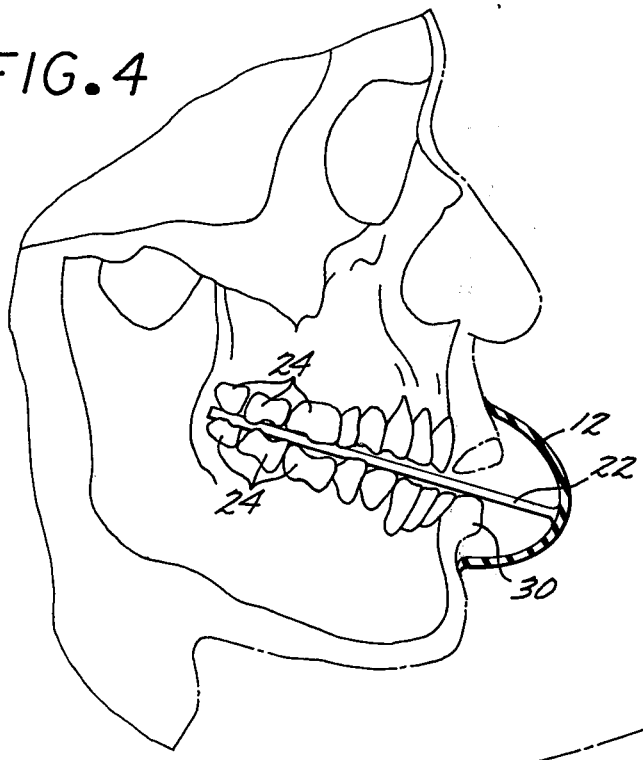
FIG. 4 is a fragmentary elevational view of the diver's head, partly in skeletal form, showing the mouthpiece gripped between the diver's molar teeth.
Figure 5:
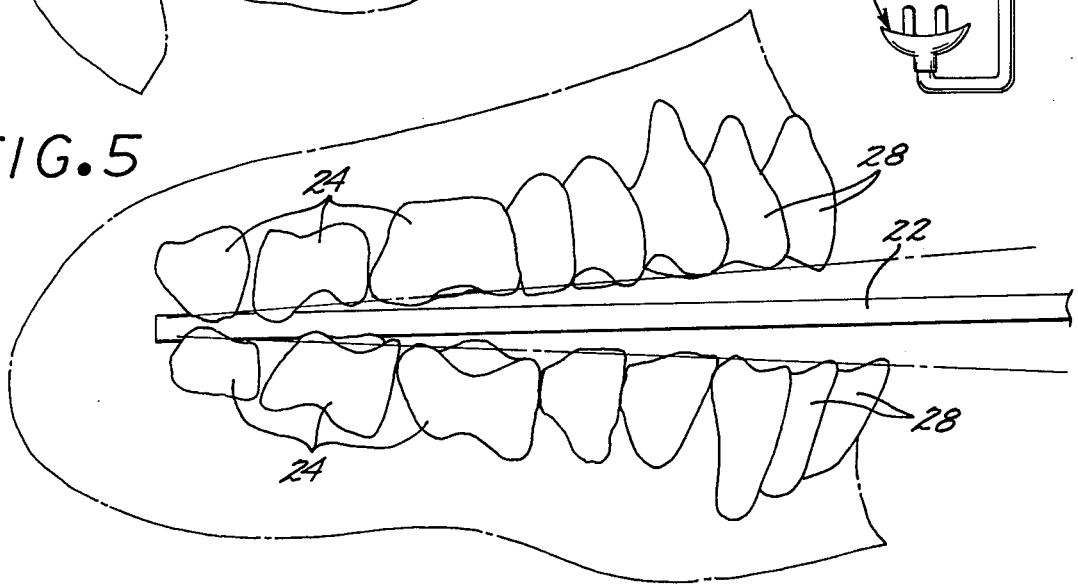
FIG. 5 is an enlarged view of one of the bit elements of the mouthpiece gripped between the diver's molar teeth.

It will be appreciated from the drawings, especially FIGS. 4 and 5 thereof, that, when the bit elements 22 are firmly gripped by the molar teeth 24, there will be a substantial space between the upper and lower front teeth or incisors 28. Moreover, since the bit elements 22 have substantial thickness and are of a resilient material, the upper and lower front teeth 28 may be moved together and apart to a limited extent, to facilitate speech by the diver. It will also, be apparent that free movement of the diver's lips is permitted when the mouthpiece 10 is being worn. Accordingly, the diver may readily articulate many speech sounds in the usual manner, and the sound will be transmitted through the central port 18, beyond which it can be detected by a microphone (not shown) or transmitted into the water through the regulator unit 20. The mouthpiece of the invention thereby increases the safety and convenience of scuba diving activities by facilitating underwater speech communication.

The mouthpiece 10, including the housing 12, tube 16 and bit elements 22, may be conveniently molded in a single piece from natural or synthetic rubber material. A retaining strap 30 (FIG. 2) may be optionally employed to ensure a close fit of the housing 12 around the diver's mouth.

The mouthpiece 10 can be worn with much less fatigue to the diver as compared to the mouthpieces currently in use. The bit elements 22 are gripped by the diver's molar teeth almost unconsciously and with little effort.

The normal, substantially closed position of the jaws brings the molar teeth into secure gripping engagement with the rear extremities of the elements 22. This contrasts with the currently used mouthpieces, in which the bit element is gripped by urging together the front teeth in biting relation. This biting action is very tiring over a period of time, and the muscles of the jaw tend to ache after extended periods of diving.

The reduced fatigue afforded through utilization of the mouthpiece 10 is an important advantage of the present invention. This advantage is also present when the mouthpiece 10 is used in connection with other underwater breathing equipment, such as the snorkel tube 32 illustrated in FIG. 6. The snorkel tube 32 is conventional in configuration except that the mouthpiece 10 is substituted for the usual mouthpiece. Although the mouthpiece 10 could be integrally molded as a part of the snorkel tube, it is more concurrently fabricated separately as shown in FIG. 1 and thereafter adhesively bonded or otherwise secured to a U-shaped tube to form the snorkel 32, as will be apparent.

Figure 6:
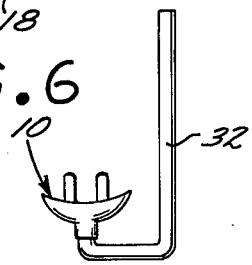
FIG. 6 is a perspective view of the mouthpiece forming part of a snorkel tube.

In the snorkel embodiment of FIG. 6 the diver is able to use his lips to better form words for underwater communication, just as was true of the embodiment of FIG. 2. However, the nature of the snorkel tube is such that the sounds articulated are not propagated with the same fidelity as was the case with the mouthpiece 10 of FIG. 2.

Although a specific embodiment of the invention has been described in detail for purposes of illustration, it will be appreciated that various changes and modifications can be made without departing from the spirit and scope of the invention. Accordingly, the invention is not to be limited except as by the appended claims.

I claim:

1. A breathing mouthpiece for underwater use comprising:

a housing having a flexible edge contoured to surround the wearer's mouth and fit snugly against the face in spaced relation to the wearer's lips to permit free movement of the lips, said housing further having a central port to breath through; and a pair of elongated, flexible bit members affixed interiorly to said housing on opposite sides of said port and sufficiently laterally spaced apart on opposite sides of said port, and projecting beyond said edge sufficiently, to fit between molar teeth of the wearer, the portion of said housing between said bit members and adjacent said port being open to permit the wearer's lips to come together adjacent said port, said bit members being sufficiently thick to allow them to be gripped by molar teeth of the wearer and sufficiently thin to enable the wearer's lips to come together whereby said mask can be held in position while yet allowing free movement of the lips and limited movement of the front teeth.

2. A breathing mouthpiece according to claim 1 wherein all of said housing is made of flexible material.

3. A breathing mouthpiece according to claim 1 and including a snorkel tube attached to said housing in communication with said port.

4. A breathing mouthpiece according to claim 1 and including an air supply regulator attached to said housing in communication with said port.

5. A breathing mouthpiece according to claim 1 wherein said bit elements are each characterized by a width substantially greater than its thickness.

* * * * *